US011361915B2

(12) United States Patent
Bruchschmidt et al.

(10) Patent No.: US 11,361,915 B2
(45) Date of Patent: Jun. 14, 2022

(54) PUSH-BUTTON SWITCH ASSEMBLY WITH MEANS FOR INDICATING A SWITCH STATUS

(71) Applicant: Eaton Intelligent Power Limited, Dublin (IE)

(72) Inventors: Frank Bruchschmidt, Dausenau (DE); Oliver Knoerrchen, Cologne (DE); Petra Ries, Bonn (DE); Nico Clausnitzer, Geisig (DE)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 17/423,119

(22) PCT Filed: Jan. 13, 2020

(86) PCT No.: PCT/EP2020/050651
§ 371 (c)(1),
(2) Date: Nov. 11, 2021

(87) PCT Pub. No.: WO2020/148209
PCT Pub. Date: Jul. 23, 2020

(65) Prior Publication Data

US 2022/0084760 A1 Mar. 17, 2022

(30) Foreign Application Priority Data

Jan. 18, 2019 (DE) ..... 10 2019 101 264.3

(51) Int. Cl.
*H01H 13/83* (2006.01)
*H01H 13/02* (2006.01)
(Continued)

(52) U.S. Cl.
CPC ..... *H01H 13/023* (2013.01); *H01H 13/14* (2013.01); *H01H 13/10* (2013.01); *H01H 2219/062* (2013.01)

(58) Field of Classification Search
CPC ..... H01H 13/023; H01H 2219/062; H01H 13/83; H01H 2219/039; H01H 2219/06;
(Continued)

(56) References Cited

U.S. PATENT DOCUMENTS 4,583,151 A 4/1986 Nagel
5,288,957 A * 2/1994 Swaybill ..... H01H 13/023 200/317
(Continued)

FOREIGN PATENT DOCUMENTS

DE 9306074 U1 8/1994
DE 19834374 A1 2/2000
(Continued)

*Primary Examiner* — Ahmed M Saeed
(74) *Attorney, Agent, or Firm* — Leydig, Voit & Mayer, Ltd.

(57) ABSTRACT

A push-button switch assembly with means for indicating a switch status includes: an actuation head for actuating the push-button switch assembly, the actuation head having a disc-shaped upper part and a tubular lower part; a sleeve-type push-button guide which is coupled to the actuation head such that, in relation to a longitudinal axis of the push-button switch assembly, the upper part is arranged above the push-button guide and the lower part surrounds the push-button guide; and a light guide for guiding light, the light guide being coupled to the actuation head such that, in relation to the longitudinal axis, at least portions of the light guide are arranged within the actuation head and within the push-button guide. The light guide extends through the actuation head with a top end in a predetermined position
(Continued)

such that the push-button switch assembly is illuminatable in a predetermined manner by a light beam.

11 Claims, 11 Drawing Sheets

(51) Int. Cl.
*H01H 13/14* (2006.01)
*H01H 13/10* (2006.01)

(58) Field of Classification Search
CPC ..... H01H 2221/07; H01H 9/181; H01H 2219/036; H01H 2219/044; H01H 2013/026; H01H 9/16; H01H 2219/0622; H01H 2219/037; H01H 2009/184; H01H 2009/164
See application file for complete search history.

(56) References Cited

U.S. PATENT DOCUMENTS 6,092,902 A * 7/2000 Weber ..... G05G 1/105 362/23.17
6,224,221 B1 5/2001 Glienicke
8,876,310 B2 * 11/2014 Nozaki ..... H01H 19/025 362/23.22

FOREIGN PATENT DOCUMENTS

| | | | |
|---|---|---|---|
| DE | 20305387 | U1 | 7/2003 |
| DE | 10342325 | A1 | 4/2005 |
| DE | 102009041542 | A1 | 3/2011 |
| EP | 1734434 | A1 | 12/2006 |
| EP | 1261979 | B1 | 5/2007 |
| EP | 2669918 | A1 | 12/2013 |
| GB | 2350722 | A | 12/2000 |

* cited by examiner

PUSH-BUTTON SWITCH ASSEMBLY WITH MEANS FOR INDICATING A SWITCH STATUS

CROSS-REFERENCE TO PRIOR APPLICATIONS

This application is a U.S. National Phase application under 35 U.S.C. § 371 of International Application No. PCT/EP2020/050651, filed on Jan. 13, 2020, and claims benefit to German Patent Application No. DE 10 2019 101 264.3, filed on Jan. 18, 2019. The International Application was published in German on Jul. 23, 2020 as WO 2020/148209 under PCT Article 21(2).

FIELD

The invention relates to a push-button switch assembly in which different switch statuses are visibly indicated on the basis of the switch position.

BACKGROUND

In the case of a push-button switch assembly, a standard stipulates that different statuses of the push-button switch assembly are clearly recognizable for an observer. The push-button switch assembly can be designed, for example, as an emergency stop switch with which an electrical contact between two conductors can be separated.

Such a push-button switch assembly usually has different components which are assembled according to a modular system, as is described, for example, in document EP 1 261 979 B1. The components of a push-button switch assembly include, for example, a generally mushroom-shaped actuation head that is placed on a push-button guide. The push-button guide can be designed as a hollow body and has a plunger in its interior, which is arranged to be movable in the axial direction in the push-button guide by means of the actuation head.

Such a push-button switch assembly can be mounted on a housing body which has a contact element in the interior. When the actuation head is pressed or turned, the plunger is moved in the interior of the push-button guide. The plunger acts on the contact element in the interior of the housing body, so that an electrical contact is, for example, separated. For this purpose, it is necessary to indicate the switch status of the push-button switch assembly in a reliable and clearly visible manner.

SUMMARY

In an embodiment, the present invention provides a push-button switch assembly with means for indicating a switch status, comprising: an actuation head configured to actuate the push-button switch assembly, the actuation head having a disc-shaped upper part and a tubular lower part; a sleeve-type push-button guide which is coupled to the actuation head such that, in relation to a longitudinal axis of the push-button switch assembly, the upper part is arranged above the push-button guide and the lower part surrounds the push-button guide; and a light guide configured to guide light, the light guide being coupled to the actuation head such that, in relation to the longitudinal axis, at least portions of the light guide are arranged within the actuation head and within the push-button guide, wherein the light guide extends through the actuation head with a top end in a predetermined position such that the push-button switch assembly is illuminatable in a predetermined manner by a light beam which, in relation to the longitudinal axis, is couplable into the light guide at a bottom end opposite the top end, and wherein the light guide comprises two parts and has a rod-shaped element which, in relation to the longitudinal axis, is connected to a funnel-shaped element, and a disc-shaped element which is coupled to the upper part of the actuation head and which, in interaction with the rod-shaped element and the funnel-shaped element, delimits a hollow space and forms a predetermined light guide function.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
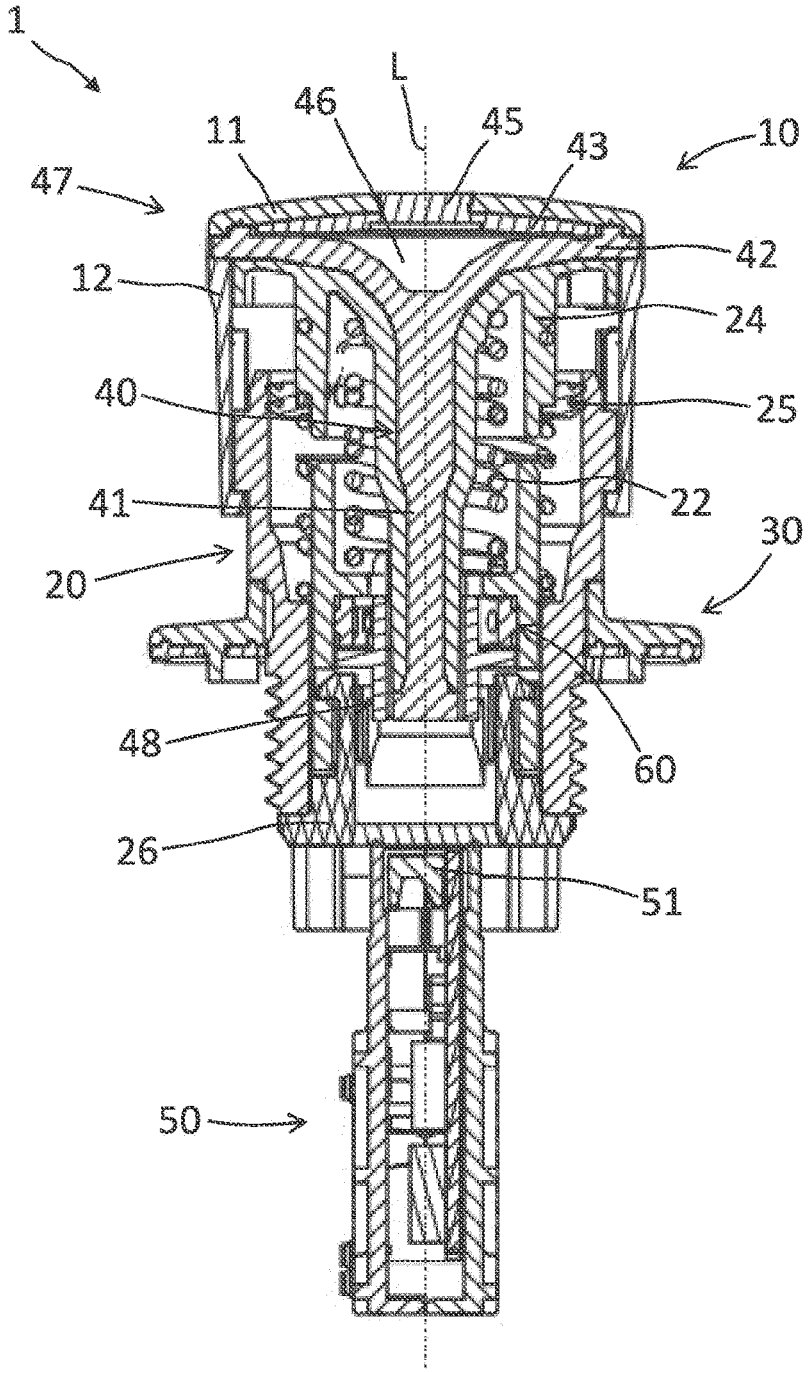
FIG. 1 shows an embodiment of a push-button switch assembly having a light guide.

In an embodiment, the present invention provides a push-button switch assembly that can be manufactured with low production costs and allows for a switch status to be displayed for an operator in a reliable and clearly recognizable manner.

A push-button switch assembly with means for indicating a switch status is specified herein. Advantageous embodiments are specified herein.

A push-button switch assembly with means for indicating a switch status comprises an actuation head for actuating the push-button switch assembly, having a disc-shaped upper part and a tubular lower part. The push-button switch assembly further comprises a sleeve-type push-button guide which is coupled to the actuation head such that, in relation to a longitudinal axis of the push-button switch assembly, the upper part is arranged above the push-button guide and the lower part surrounds the push-button guide. The push-button switch assembly also comprises a light guide for guiding light, which is coupled to the actuation head such that, in relation to the longitudinal axis, at least portions of the light guide are arranged within the actuation head and within the push-button guide. The light guide extends through the actuation head with a top end in a predetermined position such that the push-button switch assembly can be illuminated in a predetermined manner by means of a light beam which, in relation to the longitudinal axis, can be coupled into the light guide at a bottom end opposite the top end.

By means of the described push-button switch assembly, a switch status can be displayed for an operator in a reliable and clearly visible manner. The light guide allows for a beneficial light function of the push-button switch assembly, which illuminates the push-button switch assembly in predetermined positions in a manner clearly visible from outside. In addition to conventional color markings, the thus established light function realizes a light indicator and contributes to a simple and particularly reliable identification of a respective switch status.

According to a preferred development of the push-button switch assembly, the upper part of the actuation head has an opening which forms a predetermined position through which a portion of the light guide extends. The actuation head is designed, for example, to be mushroom-shaped. The light guide is designed, for example, to be rod-shaped, so that one end of the light guide extends through a circular opening in the upper part of the actuation head. Due to the advantageous light guide function provided by the light guide, a respective switch status of the push-button switch assembly can be displayed in a reliable and particularly recognizable manner.

In comparison to a push-button switch assembly which does not have a light guide, a significantly improved visibility of the switch status can be achieved. Alternatively, by means of the described push-button switch assembly, less efficient or fainter light sources can be used in order to achieve a visibility comparable to that of a conventional push-button switch assembly. This can contribute to a cost-effective and energy-saving push-button switch assembly.

In relation to the longitudinal axis, the components of the push-button switch assembly are designed in particular to be rotationally symmetrical, wherein individual elements, such as recesses and detents, can be excluded therefrom.

According to a further development of the push-button switch assembly, the actuation head is designed in two parts with the disc-shaped upper part and the tubular lower part. The light guide has an upper portion assigned to the top end, and a lower portion assigned to the bottom end, wherein, in relation to the longitudinal axis of the push-button switch assembly, the upper portion extends at least partially between the upper part and the lower part of the actuation head. In this way, a 360° lighting function can be provided, which contributes to a particularly noticeable and reliable indication of a switch status of the push-button switch assembly.

The upper part and the lower part of the actuation head are designed such that a continuous edge of the upper portion of the light guide can be clamped or arranged between them, thus allowing for a radially continuous light decoupling. In addition, as described above, a central light decoupling can be provided on one end face of the push-button switch assembly, so that a particularly clear lighting function can be realized by means of the push-button switch assembly described.

According to a further development of the push-button switch assembly, the light guide is designed in two parts and has a rod-shaped element which, in relation to the longitudinal axis, is connected to a funnel-shaped element and a disc-shaped element which is coupled to the upper part of the actuation head. In interaction with the rod-shaped element and the funnel-shaped element, the disc-shaped element delimits a hollow space and forms a predetermined light guide function. Such a configuration contributes to a particularly efficient lighting function of the push-button switch assembly.

The rod-shaped element and the funnel-shaped element can each be designed as separate components and connected to one another. Preferably, the rod-shaped element and the funnel-shaped element together form a one-piece common component of the light guide. This component of the light guide with the rod-shaped element and the funnel-shaped element realizes a Y-shape in relation to a cross section along the longitudinal axis. In other words, the shape could also be called a tulip shape. As a further separate component, the disc-shaped element forms a lid or a cover element which can be placed onto the Y-shaped component, thus enclosing a hollow space. By means of such a configuration, a predetermined portion of a coupled-in light beam can be decoupled on the continuous edge of the light guide and a further portion can be decoupled at the front of the disc-shaped element of the light guide. Alternatively, however, the light guide can also be produced in one piece and have a predetermined geometry without an enclosed hollow space.

The above-described upper portion of the light guide comprises in particular the funnel-shaped element and the disc-shaped element of the light guide and can also be called a disc-shaped portion. The above-described lower portion of the light guide comprises in particular the rod-shaped element of the light guide and can also be called a rod-shaped portion.

The light guide can in particular be formed with a predetermined geometry as part of an injection molding process. In this way, among other things, the number of parts of the light guide to be connected to one another can be kept low. The light guide preferably has highly transparent polycarbonate as the material. Alternatively, the light guide can be made of plexiglass, such as PMMA. In addition, an outer surface of the light guide can be designed to be purposefully reflective, so that a coupled-in light beam follows the shape of the light guide and only a small portion of the light emerges at undesired positions. Reflective properties of the light guide can be influenced, for example, by a coating, a mirror coating or simply by means of an applied white color layer.

According to a development of the push-button switch assembly, the light guide has a contour with one or more steps which are designed to decouple from the light guide in a predetermined manner a portion of a light beam coupled into the light guide. In this way, a particularly advantageous light guide function of the light guide can be specified.

According to a further development of the push-button switch assembly, the light guide has a corrugated surface structure on a surface that extends through the actuation head. By means of such a purposefully provided surface structure, a light scattering of the decoupling light beam can be achieved, which contributes to a particularly clear visibility of the push-button switch assembly and a respective switch status. For example, the corrugated surface is formed on the continuous outer edge of the funnel-shaped element of the light guide which is arranged between the upper part and the lower part of the actuation head. Alternatively or additionally, the light guide can also have a roughened or corrugated surface structure at other positions, which contributes to a purposefully diffuse light decoupling.

If, for example, the push-button switch assembly has a light passage surface in the form of a protruding region of the light guide in the central region of the upper part of the mushroom-shaped actuation head and also a continuous ring structure of the light guide below the upper part, a predetermined decoupling of the light beam can be established by purposefully specifying the contour of the light guide. For example, the light beam is guided through the rod-shaped element of the light guide to the funnel-shaped element and decoupled in particular at the steps which are preferably formed on the funnel-shaped element of the light guide and enters the hollow space between the funnel-shaped element and the disc-shaped element of the light guide. The light beam reaches the disc-shaped element of the light guide through the air-filled hollow space, where it is again coupled into the light guide, guided through the disc-shaped element and exits the push-button switch assembly toward the outside through the protruding region of the disc-shaped element. The geometry, such as a size of the step-shaped region, a number of steps and a size of a respective step, can be used to adjust the size of a portion of the light beam that reaches the protruding region of the disc-shaped element and is decoupled frontally, and it can be used to adjust the size of a portion of the light beam that reaches the corrugated annular surface of the funnel-shaped element and is decoupled laterally.

According to a further development, the push-button switch assembly has a sleeve-type plunger which, in relation to the longitudinal axis, surrounds the light guide and has an inner surface with predetermined reflection properties, which faces the light guide. The sleeve-type plunger is used in particular to transmit force, when the actuation head is actuated, to other components of the push-button switch assembly, such as a locking unit, and, in relation to the longitudinal axis, is arranged between the actuation head or the push-button guide and the light guide. In addition, the plunger can serve as a retaining and coupling component for the light guide. The plunger preferably replicates the shape of the light guide and couples the light guide to the actuation head and the push-button guide.

On the inner surface facing the light guide and contacting it in portions, for example, along the longitudinal axis, the plunger is particularly preferably designed such that a light beam coupled into the light guide is reflected by the inner surface of the plunger and directed back to the light guide. This can be done, for example, by means of a coating in the form of a white inner surface of the plunger.

According to a preferred development, the push-button switch assembly has a coupling sleeve which is coupled to the push-button guide at the bottom end of the light guide and has an inner surface which at least in portions has a predetermined curvature in order to direct a light beam to be coupled into the light guide in the direction of the bottom end of the light guide. Such a coupling sleeve can thus be used for mechanical coupling and retaining and also contribute a photometric coupling for the advantageous coupling of the largest possible light portion into the light guide. For example, the coupling sleeve has an elliptical curvature on an upper portion which, in an operational state of the push-button switch assembly, is arranged adjacent to the bottom end of the light guide, which has a beneficial effect on the coupling of the light beam into the light guide.

According to a further development, the push-button switch assembly has a light source unit with a light-emitting diode, which, in relation to the longitudinal axis, is coupled to the push-button guide at an end opposite the actuation head such that a light beam from the light-emitting diode can be coupled into the light guide at the bottom end of the light guide.

The push-button switch assembly can be switched from a non-released state to a released state in particular by actuating the actuation head, wherein the push-button switch assembly is designed such that, in the released state, an electrical contact between two conductors of a contact element, which can be coupled to the push-button switch assembly, can be separated if the contact element is designed as an N/C contact and the electrical contact between the two conductors is closed in the non-released state. The push-button switch assembly is designed such that, in the released state, an electrical contact between two conductors in the contact element can be closed if the contact element is designed as an N/O contact and the electrical contact between the two conductors is separated in the non-released state. The push-button switch assembly can be actuated by pressing and/or turning the actuation head.

According to a preferred development, the push-button switch assembly is designed as an emergency stop switch or a stop switch and, by means of the specifically provided light guide and the described light function, allows for a particularly reliable and clearly recognizable display of a switch status and thus contributes to safety.

In addition, the push-button switch assembly can comprise an adapter device for fastening the push-button switch assembly to a housing body, which is coupled to the push-button guide.

Elements with the same structure and function are denoted in all figures with the same reference signs. For the sake of clarity, not all of the elements shown may be denoted with associated reference signs in all of the figures.

FIG. 1 shows an embodiment of a push-button switch assembly 1 according to the invention with means for indicating a switch status. The push-button switch assembly 1 has a mushroom-shaped actuation head 10 for actuating the push-button switch assembly 1, which comprises a disc-shaped upper part 11 and a tubular lower part 12. The push-button switch assembly 1 also has a push-button guide 20. The push-button guide 20 is coupled to the actuation head 10 and, in relation to a longitudinal axis L of the push-button switch assembly 1, is arranged in the lower part 12 of the actuation head 10 such that the lower part 12 surrounds the push-button guide 20. In relation to the longitudinal axis L, the upper part 11 is arranged above the push-button guide 20.

The push-button switch assembly 1 further comprises a light guide 40 for guiding light, which is coupled to the actuation head 10 such that, in relation to the longitudinal axis L, the light guide 40 is arranged in portions within the actuation head 10 and within the push-button guide 20. The light guide 40 extends through the actuation head 10 with a top end 47 in a predetermined position such that the push-button switch assembly 1 can be illuminated in a predetermined manner by means of a light beam which, in relation to the longitudinal axis L, can be coupled into the light guide 40 at a bottom end 48 opposite the top end 47.

In relation to the embodiment shown, the light guide 40 is designed in two parts and has a first component with a rod-shaped element 41 and an adjoining funnel-shaped element 42. A separate second component is formed by a disc-shaped element 43 having a protruding region 45 which extends through a central opening 13 in the upper part 11 of the actuation head 10. Alternatively, the rod-shaped element 41 can also have a tubular design and comprise a hollow space or a channel.

The light guide 40 also extends outward between the upper part 11 and the lower part 12 through the actuation head 10 and is thus arranged to be continuous between the upper part 11 and the lower part 12. The depicted components of the push-button switch assembly 1 are, in relation to the longitudinal axis L, predominantly rotationally symmetrical. The continuous edge of the funnel-shaped element 42 of the light guide 40 therefore allows for a 360° illumination of the push-button switch assembly 1 for clearly visible identification of a switch status. In addition, light is decoupled centrally from the actuation head by the protruding region 45 of the disc-shaped element 43 and further contributes to a simple and reliable visibility of the push-button switch assembly 1.

In relation to the cross section depicted in FIG. 1, the first component 41, 42 of the light guide 40 replicates a Y structure on which the second component or the disc-shaped element 43 of the light guide 40 rests as a type of cover element. Existing lugs or grooves ensure a predetermined and stable hold of the components 41, 42, 43 of the light guide 40 with respect to one another. The described structure of the light guide 40 contributes to a particularly beneficial light guide function which allows for a clearly recognizable illumination of the push-button switch assembly 1. In particular, the depicted tulip-shaped configuration of the first component 41, 42 and the covering disc-shaped element 43 of the light guide 40, which enclose or delimit a hollow space 46, provide a beneficial light guide function that realizes a predetermined light distribution for decoupling and illuminating.

The push-button switch assembly 1 also has a sleeve-type plunger 24 which surrounds the light guide 40 in relation to the longitudinal axis L. The sleeve-type plunger 24 is used, among other things, to transmit force, when the actuation head 10 is actuated, to other components of the push-button switch assembly 1, such as a locking unit 60 which surrounds the light guide in an annular manner and allows for a switch status to engage, and, in relation to the longitudinal axis L, is arranged between the actuation head 10 or the push-button guide 20 and the light guide 40. In addition, the plunger 24 can serve as a retaining and coupling component for the light guide 40. The plunger 24 replicates the contour of the light guide 40 or the first component 41, 42 of the light guide 40 and mechanically couples the light guide 40 to the actuation head 10 and the push-button guide 20.

The plunger 24 is particularly preferably designed on the inner surface facing the light guide 40 such that the light beam coupled into the light guide 40 is reflected by the inner surface of the plunger 24 and guided further in the light guide 40. This can be done, for example, by means of a coating in the form of a white inner surface of the plunger 24. The inner surface is therefore preferably designed with predetermined reflection properties which can contribute to an advantageous guiding of the light.

The push-button switch assembly 1 also has a light source unit 50 with a light-emitting diode 51, which, in relation to the longitudinal axis L, is coupled to the push-button guide 20 by means of a coupling sleeve 26 at an end opposite the actuation head 10, so that a light beam from the light-emitting diode 51 can be coupled into the light guide 40 at the bottom end 48 of the light guide 40. A light beam from the light-emitting diode 51 enters the light guide 40 in this direction, is guided in said light guide and decoupled therefrom at the continuous edge of the funnel-shaped element 42 and the protruding region 45 of the disc-shaped element 43 and thus provides a clearly recognizable illumination of the push-button switch assembly 1, making a locating and indicating reliable.

In addition, one or more spring elements 22 are shown which preload the push-button switch assembly 1 or adjacent components of the push-button switch assembly 1. In this way, a basic status of the push-button switch assembly 1 can be set up, which can be transferred to a switch status by actuating and pressing. The push-button switch assembly 1 can be switched, for example, from a non-released state to a released state by actuating the actuation head 10, wherein the push-button switch assembly 1 is designed such that, in the released state, an electrical contact between two conductors of a contact element, which can be coupled to the push-button switch assembly 1, can be separated if the contact element is designed as an N/C contact and the electrical contact between the two conductors is closed in the non-released state. The push-button switch assembly 1 realizes, for example, an emergency stop switch or a stop switch and, by means of the specifically provided light guide 40 and the lighting function provided, allows for a particularly reliable and clearly recognizable display of a switch status and thus contributes to safety.

The push-button switch assembly 1 further comprises an annular adapter device 30 for fastening the push-button switch assembly 1 to a housing body. According to standard specifications, individual components of the push-button switch assembly 1 have predetermined color designs. With regard to an emergency stop switch, the push-button guide 20 has a green integrally-colored material, in particular an integrally-colored plastic, the color of which differs significantly from a red color of the actuation head 10 and a yellow color of the adapter device 30.

Figure 2:
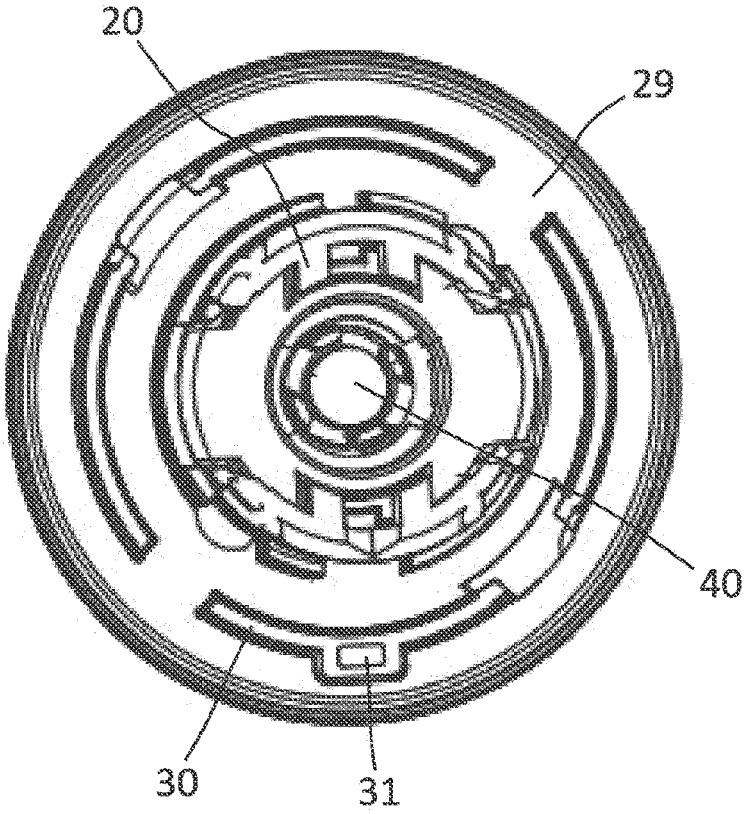
FIG. 2 shows a cross section of the push-button switch assembly according to FIG. 1.

FIG. 2 is a view of the push-button switch assembly 1 from below onto the bottom end 48 of the light guide 40 in which the central arrangement of the light guide 40 or of the rod-shaped element 41 of the light guide 40 can be seen. The light guide 40 is surrounded by the push-button guide 20, the annular adapter device 30 and an adapter centering 29. The adapter centering 29 interacts, among others, with a blocking element 31 of the adapter device 30, which form an anti-twist safeguard for the adapter device 30.

FIG. 3A to 3D are different views of an embodiment of the light guide 40 or the Y-shaped part 41, 42 of the light guide 40. On the rod-shaped element 41, the specifically shaped light guide 40 has regions with different radii which, among other things, can contribute to a stable and secure fit in the push-button switch assembly 1. Adjacent thereto is the tulip- or funnel-shaped element 42 which diverges in a direction facing away from the rod-shaped element 41. In this case, the funnel-shaped element 42 can be designed to be continuously curved or, as shown in the depicted embodiment, have one or more steps 49 which can contribute to a beneficial light guide function and light decoupling. A raised ring structure and/or lugs can be formed on a surface of the funnel-shaped element 42, which are designed to interact with the covering disc-shaped element 43.

The light guide 40 also has a corrugated surface structure 44 on a continuous edge of the funnel-shaped element 42, which extends through the actuation head 10. By means of such a purposefully provided surface structure 44, a light scattering of the decoupling light beam can be achieved, which contributes to particularly clear visibility of the push-button switch assembly 1 and a respective switch status. Alternatively or additionally, the light guide 40 can also have a roughened or corrugated surface structure 44 at further positions, which contributes to a diffuse light decoupling. The light guide 40 thus has a specifically configured shape and surface structure, each of which contributing to an advantageous light guide function and light decoupling. In addition, the surface of the light guide 40 can be high-gloss polished in order to contribute to an advantageous light guiding.

Figure 3A:
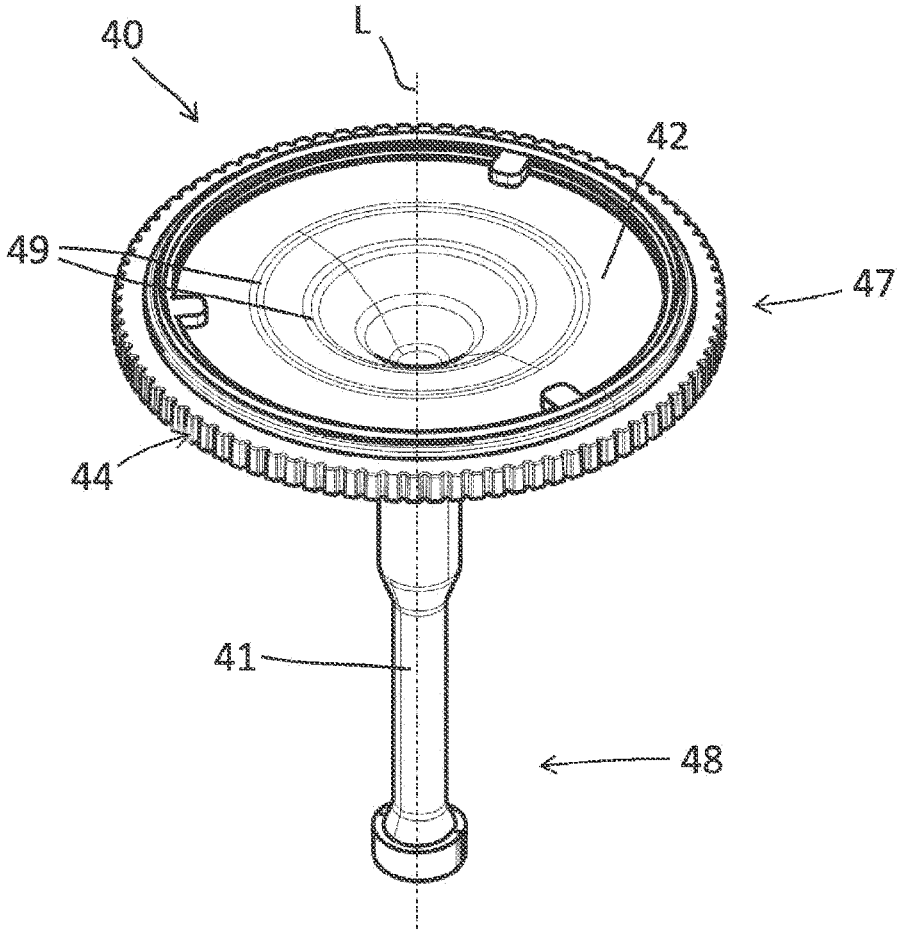
FIG. 3A-3D show an embodiment of a light guide for the push-button switch assembly according to FIG. 1.
Figure 3B:
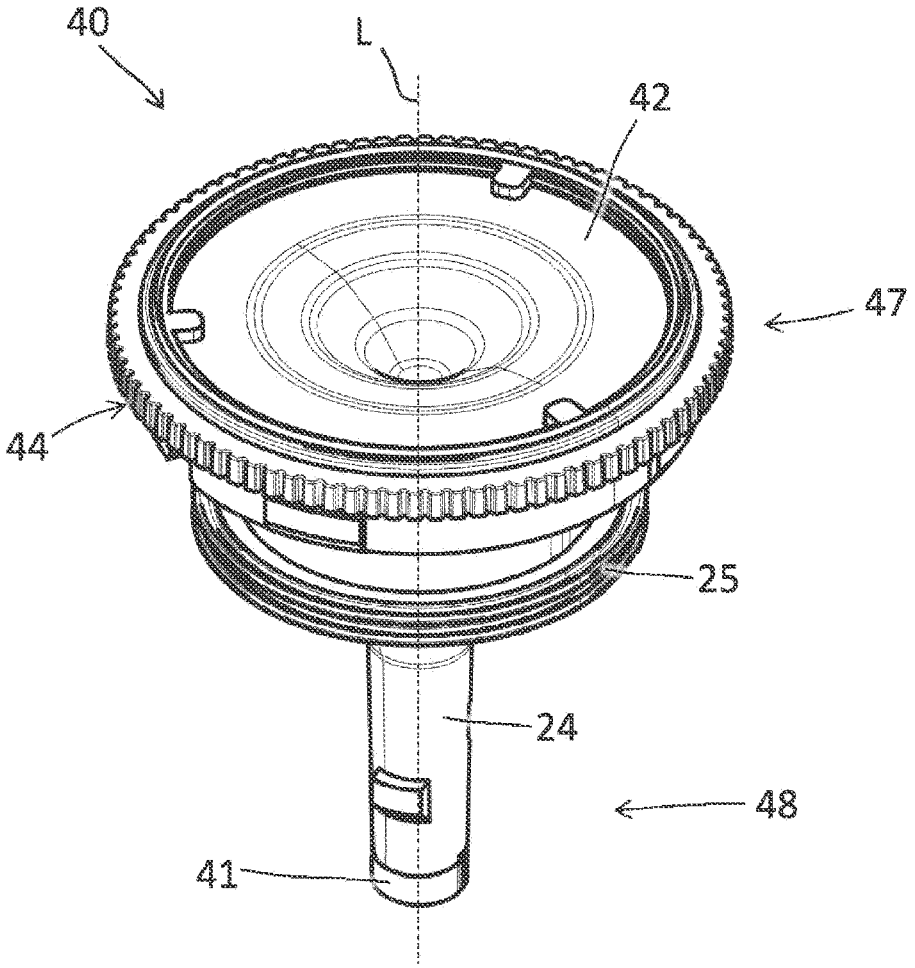

FIG. 3B shows the light guide 40 with the sleeve-type plunger 24 attached thereto which forms a laterally enclosing cover for part of the light guide 40. On the plunger 24, protruding regions, lugs and/or recesses are provided which, in relation to a longitudinal axis L, allow for an attachment and coupling to components of the push-button switch assembly 1 located further away. In addition, a sealing element 25 is shown which seals the push-button switch assembly in an upper region of the push-button guide 20 (cf. FIG. 1).

Figure 3C:
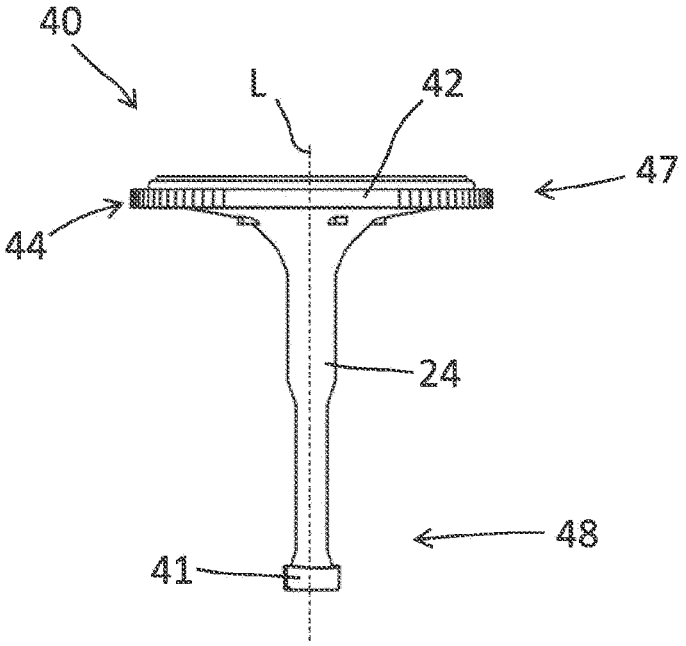
Figure 3D:
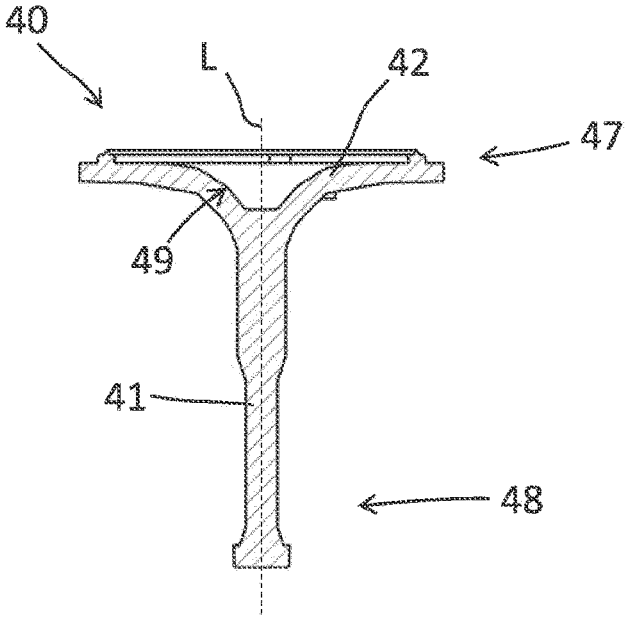

FIG. 3C is a side view of the first component 41, 42 of the light guide 40. FIG. 3D is a cross-sectional view.

Figure 4A:
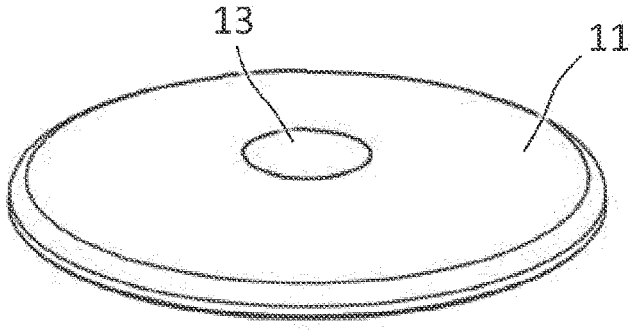
FIG. 4A-4C show an embodiment of an upper part of an actuation head and an element of the light guide for the push-button switch assembly according to FIG. 1.
Figure 4B:
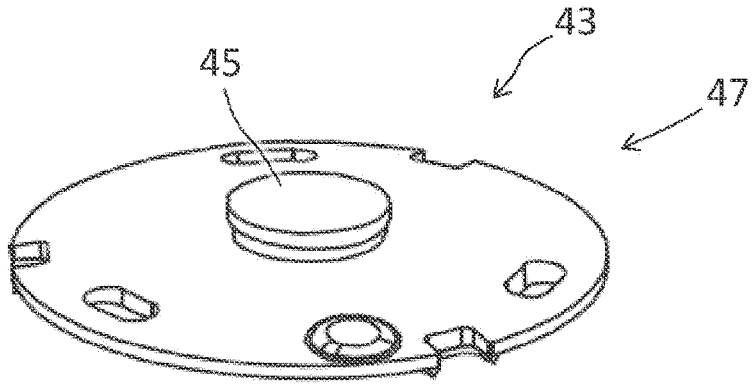
Figure 4C:
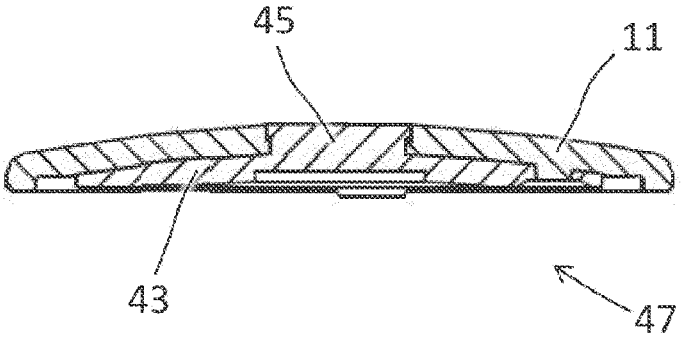

FIG. 4A to 4C are different views of the upper components of the push-button switch assembly 1. FIG. 4A illustrates the upper part 11 of the actuation head 10 with the central opening 13, in which the correspondingly shaped protruding region 45 of the disc-shaped element 43 of the light guide 40 engages in an assembled state (cf. FIGS. 4B and 4C). Edges, lugs and/or recesses of the upper part 11 and/or of the disc-shaped element 43 contribute, for example, to a simple and secure attachment of the respective components when the push-button switch assembly 1 is assembled.

FIG. 5A to 5D are further views of the partially assembled light guide 40 on which the upper part 11 of the actuation head 10 and the sleeve-type plunger 24 are already arranged. Among other things, it can be seen in FIGS. 5A and 5B that the corrugated surface structure 44 on the outward facing edge of the funnel-shaped element 42 does not necessarily have to be configured over its entire circumference but can also be configured in portions in order to realize a local light scattering.

Figure 5A:
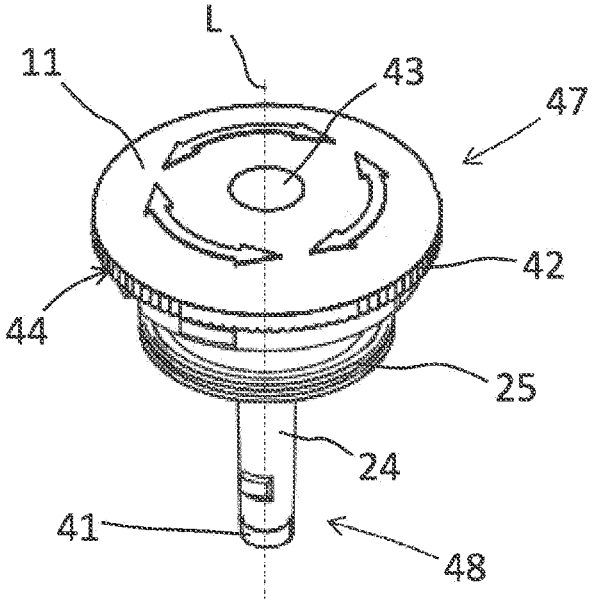
FIG. 5A-5D show an embodiment of the upper part of the actuation head and the light guide for the push-button switch assembly according to FIG. 1.
Figure 5B:
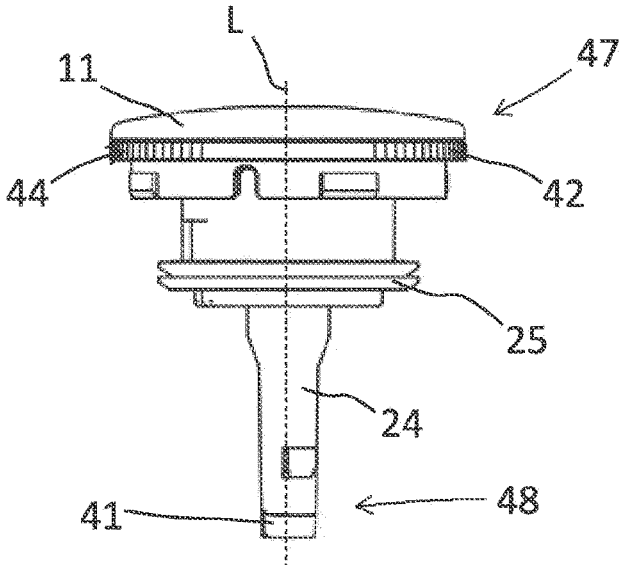
Figure 5C:
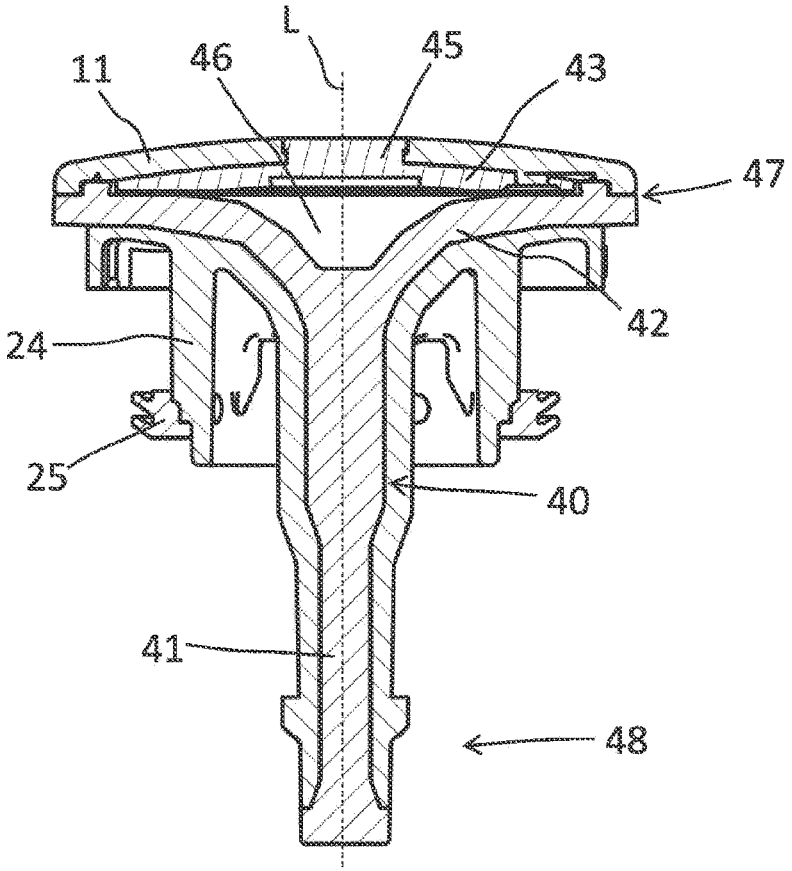
Figure 5D:
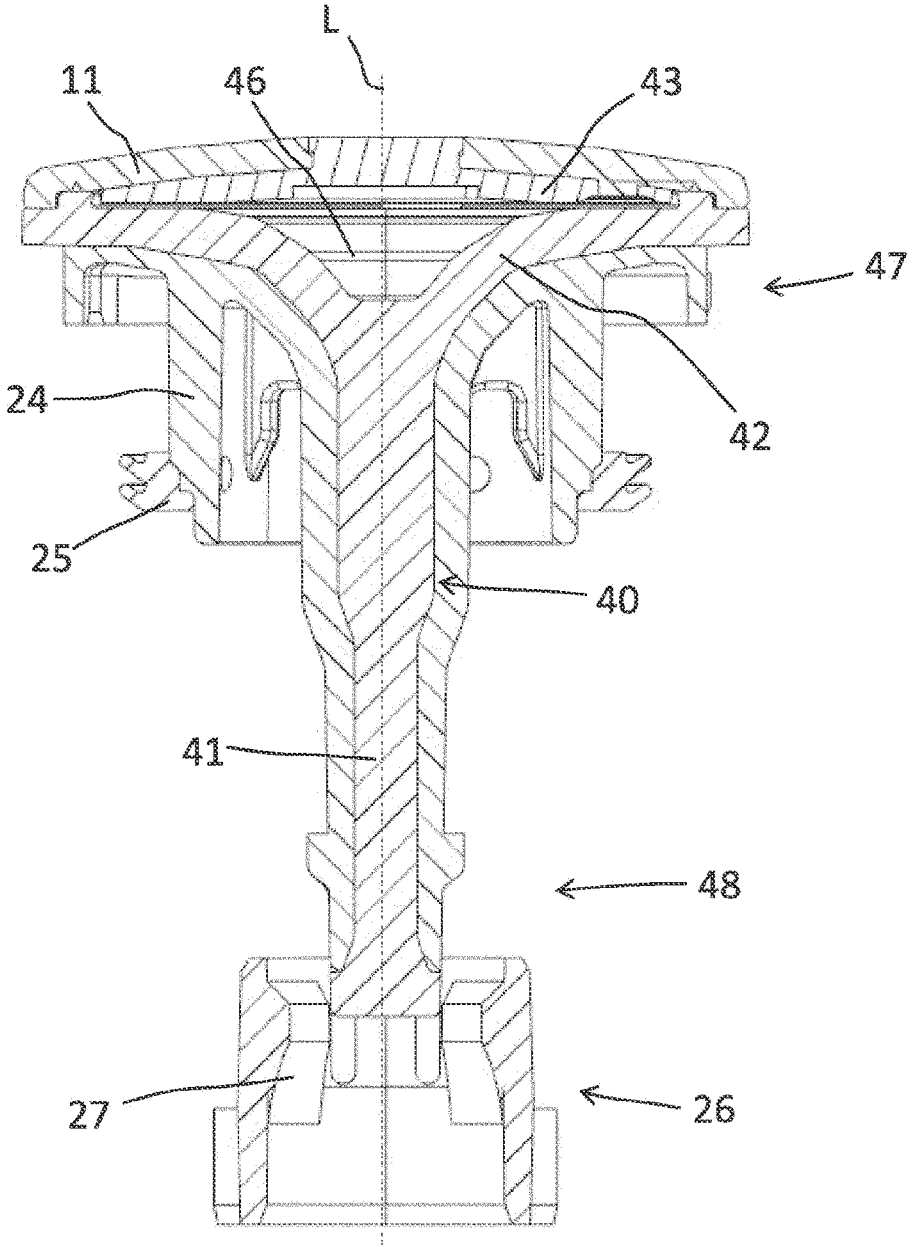
Figure 6A:
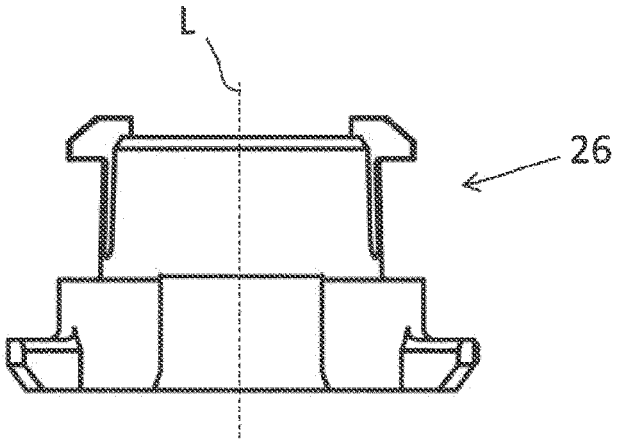
FIG. 6A-6B show an embodiment of a coupling sleeve for the push-button switch assembly according to FIG. 1.
Figure 6B:
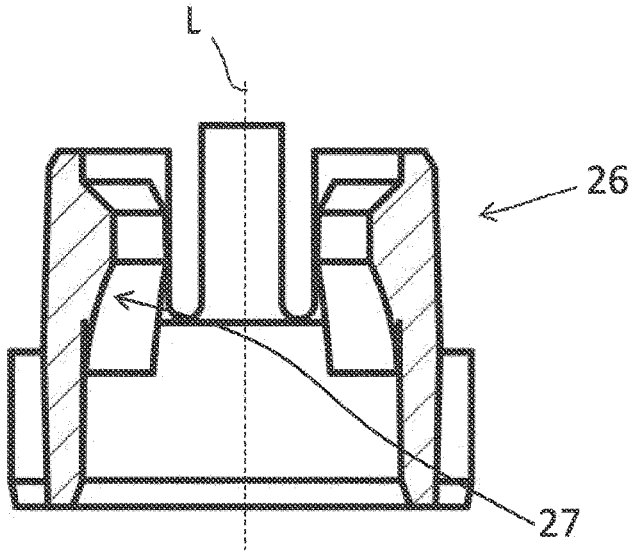

In FIG. 5D, the coupling sleeve 26 is arranged as a further component of the push-button switch assembly 1 on the bottom end 48 of the light guide 40. FIGS. 6A and 6B are further views of the coupling sleeve 26. The coupling sleeve 26 is coupled to the push-button guide 20 at the bottom end 48 of the light guide 40 (cf. FIG. 1). It preferably has an inner surface 27 which, at least in portions, has a predetermined curvature in order to contribute to an advantageous coupling of light from the light beam of the light emitting diode 51 into the light guide 40. For example, on the upper portion facing the light guide 40, the coupling sleeve 26 has an elliptical curvature which has a beneficial effect on the coupling of a light beam into the light guide 40. The coupling sleeve 26 can be used for mechanical coupling and retaining, for example, for connecting the light source unit 50, and also contribute to an advantageous photometric coupling of the largest possible portion of light into the light guide 40. Material, coating and in particular the shape of the coupling sleeve 26 contribute to guiding the light.

In addition, a respective material as well as a respective shape and color of the components of the push-button switch assembly 1 influencing the light guide are preferably designed to be coordinated with one another such that they contribute to the best possible light transmission and light guide function and form an advantageous and clearly recognizable illumination of the push-button switch assembly 1.

By means of the described push-button switch assembly 1, a switch status can be displayed for an operator in a reliable and clearly visible manner. The specifically provided light guide 40 allows for a beneficial light function of the push-button switch assembly 1, realizes a light indicator in addition to conventional color markings, and contributes to a particularly reliable indication of a respective switch status.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SIGNS

1 Push-button switch assembly
10 Actuation head
11 Upper part of the actuation head
12 Lower part of the actuation head
13 Opening of the upper part
20 Push-button guide of the push-button switch assembly
22 Spring element
24 Sleeve-type plunger
25 Sealing element
26 Coupling sleeve
27 Curved inner surface of the coupling sleeve
29 Adapter centering
30 Adapter device of the push-button switch assembly
31 Blocking element of the adapter device
40 Light guide
41 Rod-shaped element of the light guide
42 Funnel-shaped element of the light guide
43 Disc-shaped element of the light guide
44 Corrugated surface of the funnel-shaped element
45 Protruding region of the disc-shaped element
46 Hollow space of the light guide
47 Top end of the light guide
48 Bottom end of the light guide
49 Steps of the light guide
50 Light source unit
51 Light-emitting diode of the light source unit
60 Locking unit

The invention claimed is:

1. A push-button switch assembly with means for indicating a switch status, comprising:

an actuation head configured to actuate the push-button switch assembly, the actuation head having a disc-shaped upper part and a tubular lower part, a sleeve-type push-button guide which is coupled to the actuation head such that, in relation to a longitudinal axis of the push-button switch assembly, the upper part is arranged above the push-button guide and the lower part surrounds the push-button guide; and a light guide configured to guide light, the light guide being coupled to the actuation head such that, in relation to the longitudinal axis, at least portions of the light guide are arranged within the actuation head and within the push-button guide, wherein the light guide extends through the actuation head with a top end in a predetermined position such that the push-button switch assembly is illuminatable in a predetermined manner by a light beam which, in relation to the longitudinal axis, is couplable into the light guide at a bottom end opposite the top end, and wherein the light guide comprises two parts and has a rod-shaped element which, in relation to the longitudinal axis, is connected to a funnel-shaped element, and a disc-shaped element which is coupled to the upper part of the actuation head and which, in interaction with the rod-shaped element and the funnel-shaped element, delimits a hollow space and forms a predetermined light guide function.

2. The push-button switch assembly of claim 1, wherein the upper part of the actuation head has an opening which forms a predetermined position through which a portion of the light guide extends.

3. The push-button switch assembly of claim 1, wherein the actuation head comprises two parts, wherein the light guide has an upper portion assigned to the top end and a lower portion assigned to the bottom end, and wherein the upper portion, in relation to the longitudinal axis, extends partially between the upper part and the lower part of the actuation head.

4. The push-button switch assembly of claim 1, wherein the light guide has a contour with one or more steps which are configured to decouple from the light guide in a predetermined manner a portion of a light beam coupled into the light guide.

5. The push-button switch assembly of claim 1, wherein the light guide has a corrugated surface structure on a surface that extends through the actuation head.

6. The push-button switch assembly of claim 5, wherein the light guide, in relation to the longitudinal axis, extends circumferentially through the actuation head below the upper part and the surface having the corrugated surface structure is annular.

7. The push-button switch assembly of claim 1, further comprising:

a sleeve-type plunger which, in relation to the longitudinal axis, surrounds the light guide and has an inner surface with predetermined reflection properties, which faces the light guide.

8. The push-button switch assembly of claim 1, further comprising:

a coupling sleeve which is coupled to the push-button guide at the bottom end of the light guide and which has an inner surface which, at least in portions, has a predetermined curvature in order to direct a light beam to be coupled into the light guide in a direction of the bottom end of the light guide.

9. The push-button switch assembly of claim 1, further comprising:

a light source unit with a light-emitting diode, which, in relation to the longitudinal axis, is coupled to the push-button guide at an end opposite the actuation head such that a light beam from the light-emitting diode is couplable into the light guide at the bottom end of the light guide.

10. The push-button switch assembly of claim 1, wherein the push-button switch assembly is switchable from a non-released state to a released state by actuating the actuation head, wherein the push-button switch assembly is configured such that, in the released state, an electrical contact between two conductors of a contact element, which is couplable to the push-button switch assembly, is separable if the contact element comprises an N/C contact and the electrical contact between the two conductors is closed in the non-released state, and wherein the push-button switch assembly is configured such that, in the released state, an electrical contact between two conductors in the contact element is closable if the contact element comprises an N/O contact and the electrical contact between the two conductors is separated in the non-released state.

11. The push-button switch assembly of claim 1, wherein the push-button switch assembly comprises an emergency stop switch or a stop switch.

* * * * *